US005102606A

United States Patent [19]

Ake et al.

[11] Patent Number: 5,102,606

[45] Date of Patent: Apr. 7, 1992

[54] PRIMARY BLADE TEMPERING FOR HIGH SPEED MICROCREPING

[75] Inventors: Todd M. Ake, Martinez, Ga.; Peter K. Costello; Kurt T. Otto, both of Neenah, Wis.

[73] Assignee: Kimberly-Clark Corporation, Neenah, Wis.

[21] Appl. No.: 669,834

[22] Filed: Mar. 15, 1991

[51] Int. Cl.[5] ..... B31F 1/14

[52] U.S. Cl. ..... 264/282; 26/18.6; 162/280

[58] Field of Search ..... 264/282; 26/18.6; 162/111, 280, 281, 282; 148/14

[56] References Cited

U.S. PATENT DOCUMENTS

| | | | |
|---|---|---|---|
| 4,325,758 | 4/1982 | Milligan | 148/125 |
| 4,359,351 | 11/1982 | Levis | 148/16.7 |
| 4,919,877 | 4/1990 | Parsons et al. | 264/282 |

*Primary Examiner*—James Lowe

*Attorney, Agent, or Firm*—Gregory E. Croft

[57] ABSTRACT

The operating speed of a microcreping process and the crossdeckle product uniformity can be significantly improved by tempering the primary blade at temperatures of about 850° F. or greater.

3 Claims, No Drawings

PRIMARY BLADE TEMPERING FOR HIGH SPEED MICROCREPING

BACKGROUND OF THE INVENTION

U.S. Pat. No. 4,919,877 to Parsons et al. describes a method for softening webs commonly known as microcreping. The method described by Parsons et al. generally involves compression of the web in a cavity formed between the surface of a rotating cylinder, a retarder blade and a primary blade. While the process can be very effective in softening a web and imparting desirable properties, the speed at which the process can be operated can be a drawback from a commercial perspective. It has been found that at process speeds greater than about 1900 feet per minute caused an unacceptable variation in the quality of the creping across the deckle of the machine. Accordingly there is a need for improving the microcreping process so that higher operating speeds can be maintained while also maintaining product quality.

SUMMARY OF THE INVENTION

It has now been discovered that a cause of declining product quality at high operating speeds is the warping of the primary blade across the deckle of the machine. It is speculated that the cause of warping is a variation in localized temperatures which may reach 850° F. or greater. Even though the primary blade materials as normally purchased have already been tempered, apparently the conventional tempering treatments are insufficient for use in a high speed microcreping process. Accordingly, it has been discovered that tempering the primary blade at or above the expected high operating temperatures enables attainment of significantly higher operating speeds without loss in cross deckle product quality. At the same time, one must be careful not to over temper the primary blade to the point where the hardness of the blade is too low to maintain adequate wear longevity.

Hence the invention resides in a continuous process for softening a web wherein the web is supported on the surface of a rotating drum and lengthwise compressed in a treatment cavity defined by the surfaces of the rotating drum, a rigid primary blade which presses the web against the surface of the drum, and an inclined rigid retarder blade which retards the forward movement of the web and dislodges the web from the surface of the rotating drum, the improvement comprising a high carbon steel primary blade which has been tempered at a temperature of about 850° F. or greater and which has a hardness of about 45 Rockwell C or greater. The microcreping process for softening webs in which this invention is applicable is described in the above-mentioned Parsons et al. U.S. Pat. No. 4,919,877, which is hereby incorporated by reference.

The method of tempering the primary blade can be any suitable tempering method as is known in the tempering art. In essence, tempering involves a treatment in which the primary blade is subjected to a gradual increase in temperature up to the desired temperature of about 850° F. or greater followed by a decrease in temperature back to room temperature in order to modify the nature of the material of the primary blade to make it more heat resistant. The maximum tempering temperature is preferably about 1000° F. Tempering temperatures above 1000° F. tend to reduce the hardness of the primary blade to a level which adversely affects the wear resistance and longevity of the primary blade in use. For purposes herein, the maximum temperature is the highest temperature to which the primary blade is exposed for at least about 15 minutes. Exposures for shorter periods of time have a reduced effect on the tempering treatment.

A preferred tempering schedule for a primary blade of AISI 1095 spring steel is to place the primary blade in an oven and heat for one hour to 200° F. The oven temperature is increased 200° F. every hour until a final temperature of 1000° F. is reached and sustained for one hour. The primary blade is left in the oven as the oven temperature cools to room temperature, which takes about 6 hours. This heat treatment schedule can be varied in time and/or temperature to alter the characteristics of the primary blade as desired and will to some extent depend upon the steel of the primary blade. However, for this particular primary blade, the foregoing heat treatment enabled increasing the speed of the microcreping process to 3500 feet per minute or greater on a variety of basesheets without a loss in cross deckle product quality.

The type of steel used to make up the primary blade can be any high carbon steel (a steel with a carbon content greater than about 0.7 weight percent). Particular steels which are suitable include, without limitation, AISI 1075, 1078, 1080, 1084 and 1095 spring steel.

The hardness of the treated primary blades is preferably about 45 Rockwell C or greater and most preferably about 50 Rockwell C or greater. Primary blades having lower hardness values wear out too quickly to be of commercial value since it is necessary to shut the machine down to change blades. Hardness is also a function of the maximum tempering temperature, the hardness decreasing with increasing tempering temperature. Hence one must balance the desirability for high degree of hardness with the desirability for a high degree of heat stability.

The heat treatment described herein can also be applied to other microcreping hardware such as the retarder blade, back-up blades and the pressure plate to further enhance cross deckle product quality consistency and therefore speed of operation.

We claim:

1. In a continuous process for softening a web wherein the web is supported on the surface of a rotating drum and lengthwise compressed in a treatment cavity defined by the surfaces of the rotating drum, a rigid primary blade which presses the web against the rotating drum, and an inclined rigid retarder blade which retards the forward movement of the web and dislodges the web from the surface of the rotating drum, the improvement comprising a high carbon steel primary blade which has been tempered at temperature of about 850° F. or greater and which has a hardness of about 45 Rockwell C or greater.

2. The process of claim 1 wherein the primary blade has been tempered at a temperature of about 1000° F. or greater.

3. The process of claim 1 or 2 wherein the primary blade has a hardness of about 50 Rockwell C or greater.

* * * * *